US006966206B2

(12) United States Patent
Masseth, Jr. et al.

(10) Patent No.: US 6,966,206 B2
(45) Date of Patent: Nov. 22, 2005

(54) SNAP-IN LOCK RETENTION SYSTEM FOR A SAFE

(75) Inventors: James E. Masseth, Jr., Henrietta, NY (US); David A. Nowicky, Fairport, NY (US)

(73) Assignee: John D. Brush & Co., Inc., Rochester, NY (US)

( * ) Notice: Subject to any disclaimer, the term of this patent is extended or adjusted under 35 U.S.C. 154(b) by 0 days.

(21) Appl. No.: 10/268,347

(22) Filed: Oct. 10, 2002

(65) Prior Publication Data

US 2004/0069029 A1 Apr. 15, 2004

(51) Int. Cl.[7] ..... E05B 9/08
(52) U.S. Cl. ..... 70/370; 70/451; 70/466
(58) Field of Search ..... 70/370, 448, 451, 70/466, 452, 449; 292/DIG. 53, DIG. 64, DIG. 38

(56) References Cited

U.S. PATENT DOCUMENTS

| | | | | |
|---|---|---|---|---|
| 1,207,465 A | | 12/1916 | Augenbraun | |
| 2,610,500 A | | 9/1952 | Poupitch | 70/370 |
| 2,948,141 A | | 9/1960 | Vahlstrom | 70/370 |
| 4,099,397 A | | 7/1978 | Dauenbaugh | 70/371 |
| 4,640,478 A | | 2/1987 | Leigh-Monstevens | 248/27.1 |
| 4,735,534 A | | 4/1988 | Oehlke | 411/177 |
| 4,977,766 A | | 12/1990 | Beattie et al. | 70/316 |
| 5,297,405 A | | 3/1994 | Manning et al. | 70/208 |
| 5,410,899 A | | 5/1995 | McConnell | 70/370 |
| 5,479,800 A | | 1/1996 | Myers | 70/365 |
| 5,551,268 A | | 9/1996 | Carnes et al. | 70/370 |
| 5,606,883 A | * | 3/1997 | Svec | 70/370 |
| 5,636,540 A | | 6/1997 | Myers | 70/370 |
| 6,079,241 A | | 6/2000 | Burleigh et al. | 70/370 |
| 6,161,404 A | | 12/2000 | Westwinkel | 70/370 |
| 6,240,751 B1 | * | 6/2001 | Marzolf et al. | 70/207 |
| 6,305,725 B1 | * | 10/2001 | Antonucci et al. | 292/67 |
| 6,463,774 B2 | * | 10/2002 | Sokurenko | 70/360 |
| 6,502,871 B1 | * | 1/2003 | Malmanger | 292/204 |
| 6,508,092 B1 | * | 1/2003 | Laabs et al. | 70/370 |
| 6,550,295 B2 | * | 4/2003 | Hubner | 70/208 |
| 6,595,033 B1 | * | 7/2003 | Hara et al. | 70/370 |

* cited by examiner

*Primary Examiner*—John B. Walsh
(74) *Attorney, Agent, or Firm*—Jaeckle Fleischmann & Mugel, LLP

(57) ABSTRACT

This system allows a lock to be snap fit into an escutcheon plate in a secure mount that holds the lock irremovability in place in a proper position so that it cannot rotate or slide axially inward or outward. The lock socket has a pair of alignment flats to receive the lock in a proper orientation and an opposed pair of resilient snap locks. The resilient snap locks are free to move radially in and out. The lock barrel has a cam surface leading up to the diameter that fits in the lock socket. The diameter includes a pair of alignment flats and an opposed pair of snap lock flats. As the lock is inserted, the cam surface spreads open the resilient snap locks. These pass over the retainer lip and snap into the snap lock flats where the snap locks retain the lock barrel against axial movement.

12 Claims, 5 Drawing Sheets

SNAP-IN LOCK RETENTION SYSTEM FOR A SAFE

TECHNICAL FIELD

Our invention deals with a lock retention system for a safe that allows a lock to be securely mounted by merely snapping the lock into operating position without the necessity of using separate clips, pins, or other retainers to hold the lock in place.

BACKGROUND OF THE INVENTION

The bodies and doors/lids of our company's fire-resistant storage containers, also referred to as fire-resistant safes, are constructed by joining internal and external shells together so that they form a mold that can be filled with insulation material. (The insulation material itself is generally a concrete mixture that solidifies in the mold formed by the internal and external shells.) Each double-walled shell is molded with a pair of funnels that are used to help fill the shell with the insulation material. Escutcheons are mounted over the funnels immediately after the shells are filled. These escutcheons are made with stakes having shaped ends that are inserted through the funnels and embedded in the insulation material before the insulation material has hardened in place.

Lock cylinders for the safe and mechanisms related thereto are normally affixed underneath and to one of these escutcheons. In order to accomplish this in the most cost effective and efficient manner, it is desirable to make the operation as simple as possible. In most applications, a separate fastener clip or member is used to retain a lock cylinder in a panel or socket. However, some have sought to simplify this operation even more by producing snap-in locks that do not use separate fasteners and retainers. U.S. Pat. No. 5,297,405 issued to Manning et al. in 1994 for a "Door Handle Assembly with Snap-in Key Cylinder" provides one example of such an attempt.

In U.S. Pat. No. 5,297,405 ("Manning"), the inward side of a door handle assembly has semi-rigid fingers that extend inwardly. These fingers are shaped so as to snugly embrace and abut the sides of a key cylinder inserted from the rear. Each finger has a rectangular opening that receives a snap-in stud located on the exterior of the key cylinder when the cylinder is inserted into position. A narrowed opening where the key slot is exposed is too small for the key cylinder to slide forward and through. Further motion in this direction is, therefore, blocked. Once the studs have snapped into the previously described openings, the key cylinder also cannot slide back. Thus, Manning presents one means and apparatus by which a manufacturer has sought to simplify and expedite the process of lock installation; however, there remains a need for other methods and apparatus to accomplish this same purpose.

SUMMARY OF THE INVENTION

Our invention allows a lock to be snap fit into an escutcheon plate in a secure mount that holds the lock irremovably in place in a proper position so that it cannot rotate or slide axially inward or outward. It eliminates the need for any fastener, since the complete locking effect is supplied by the shape of the lock barrel and the molded shape of the lock socket/escutcheon plate.

The lock socket molded into the escutcheon plate has a pair of alignment flats to receive the lock in a proper orientation and an opposed pair of resilient snap locks. These are free to move radially in and out by virtue of a slot that partially separates the snap locks from the rest of the escutcheon plate.

The lock barrel has cam surfaces leading up to the diameter that fits in the lock socket. This diameter also includes a pair of alignment flats and an opposed pair of snap lock flats. A lock flange on the outside of the lock limits depth of insertion of the lock into its socket. As the lock is inserted, the cam surface radially spreads open the resilient snap locks. These pass over the retainer lip of the cam surfaces and snap into the snap lock flats where the snap locks retain the lock barrel against axial movement.

This arrangement allows the lock with its lock bar to be maneuvered into the lock socket and then simply snapped in place. The snap lock retainers have adequate resilience and strength to hold the lock firmly in snapped position against any axial movement. The assembly needs no fasteners or anchorage other than the escutcheon plate, which is secured to the safe by an interlock with the concrete insulation material that fills the safe.

DESCRIPTION OF THE INVENTION

Figure 1:
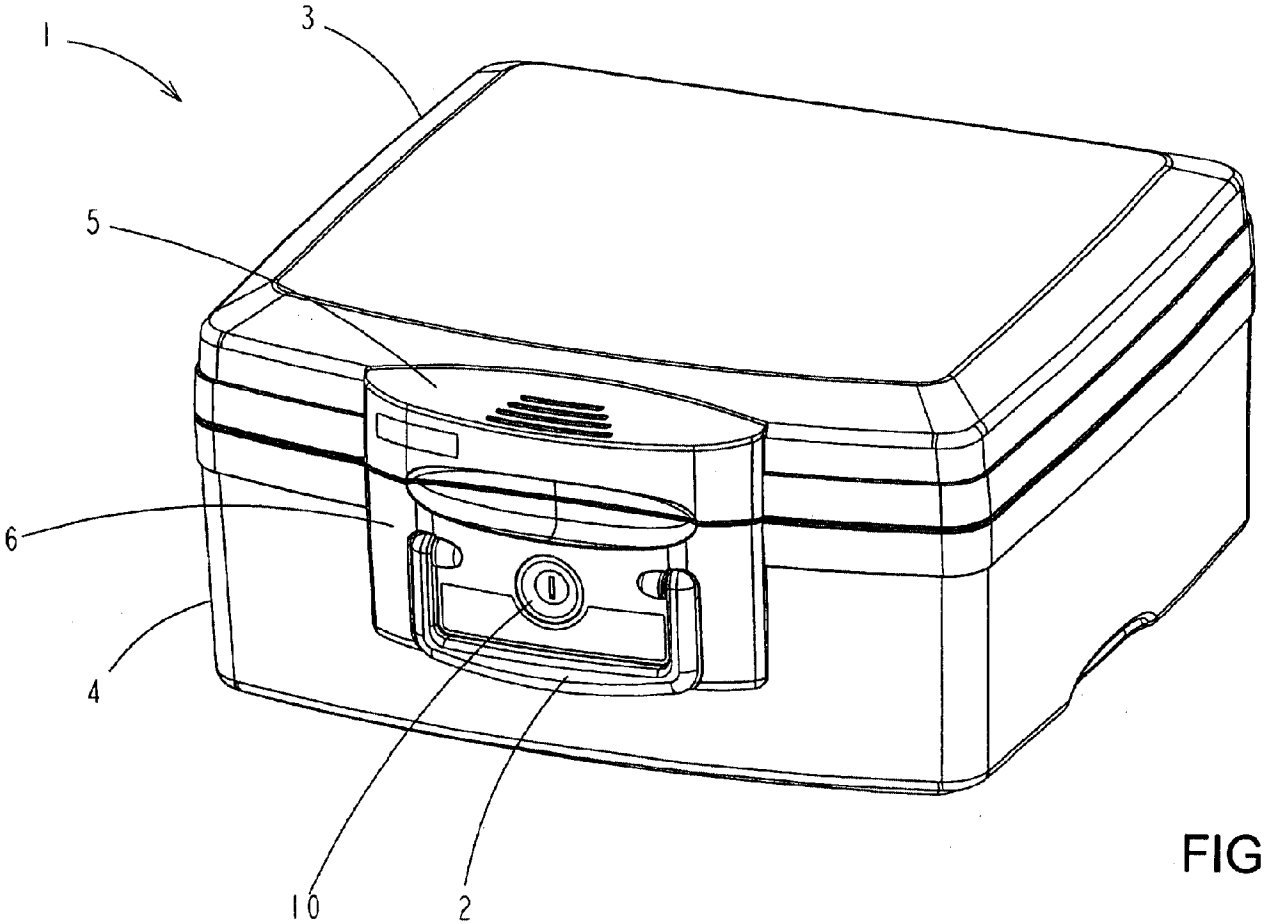
FIG. 1 provides a perspective view from the outside of a portable fireproof safe including our snap-in lock retention system.
Figure 2A:
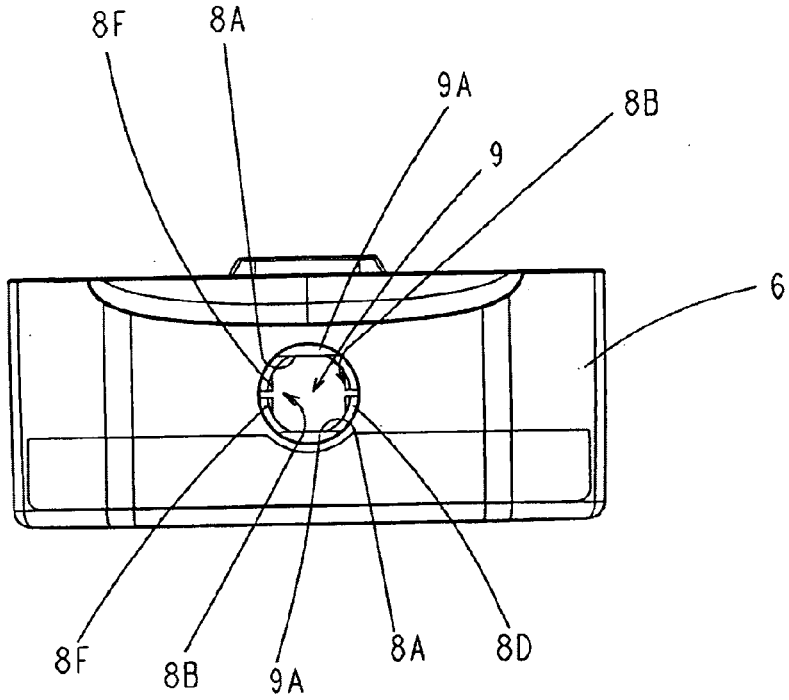
FIG. 2A provides a front view of a lower escutcheon incorporating our snap-in lock retention system.
Figure 2B:
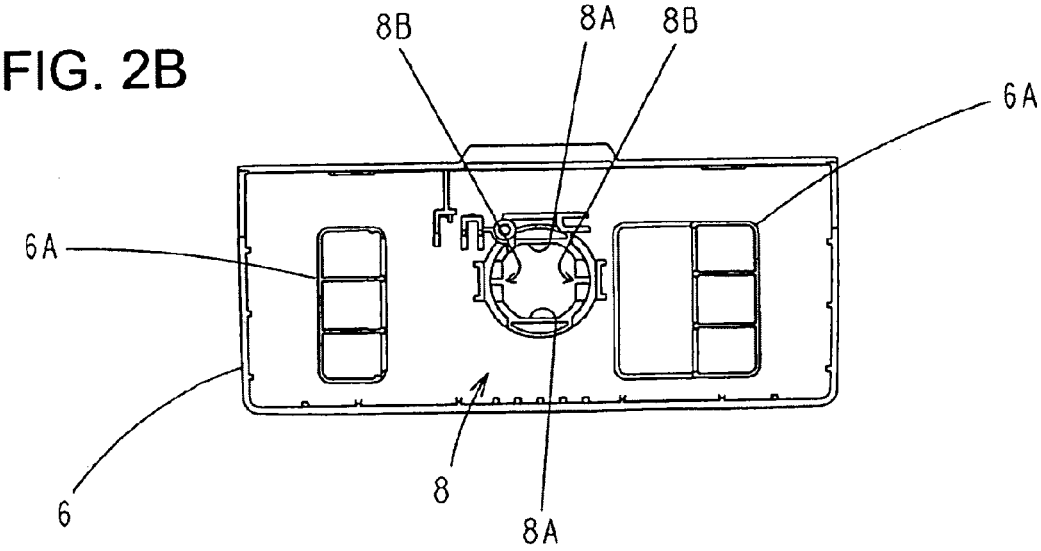
FIG. 2B provides a back view of a lower escutcheon incorporating our snap-in lock retention system.
Figure 3A:
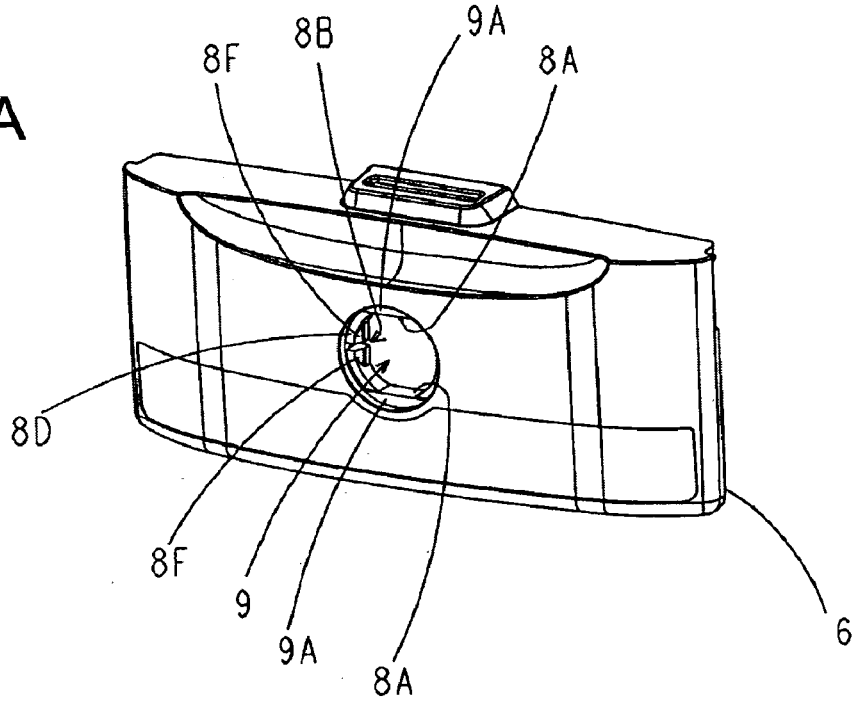
FIG. 3A provides a front perspective view of a lower escutcheon incorporating our snap-in lock retention system.
Figure 3B:
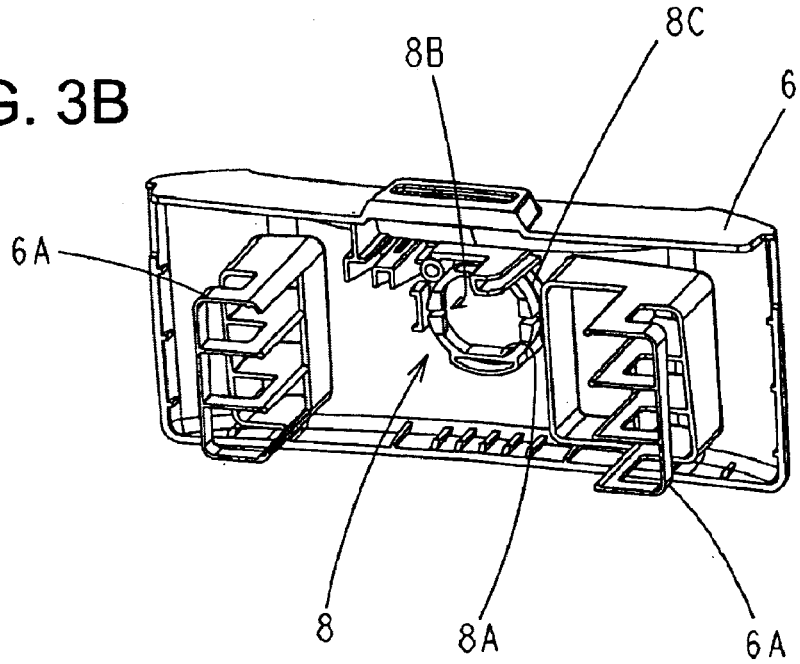
FIG. 3B provides a first back perspective view of a lower escutcheon incorporating our snap-in lock retention system.
Figure 4A:
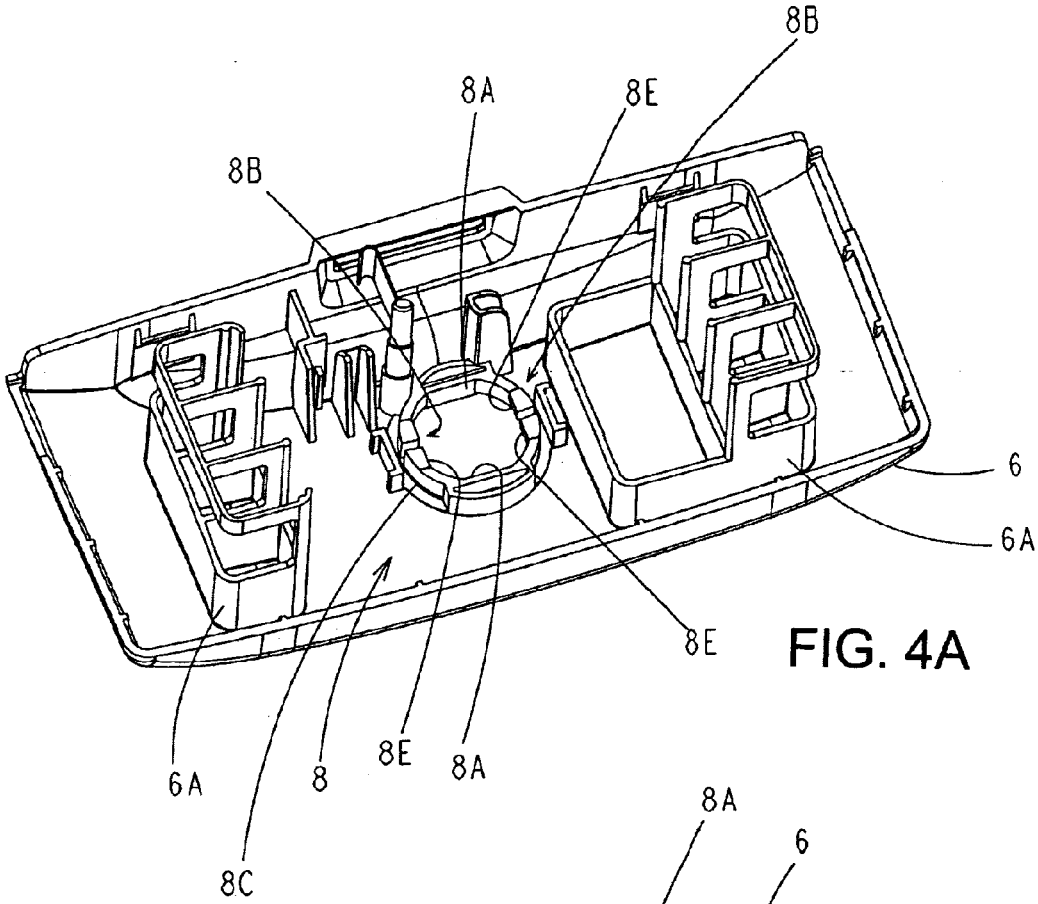
FIG. 4A provides a second back perspective view of a lower escutcheon incorporating our snap-in lock retention system.
Figure 4B:
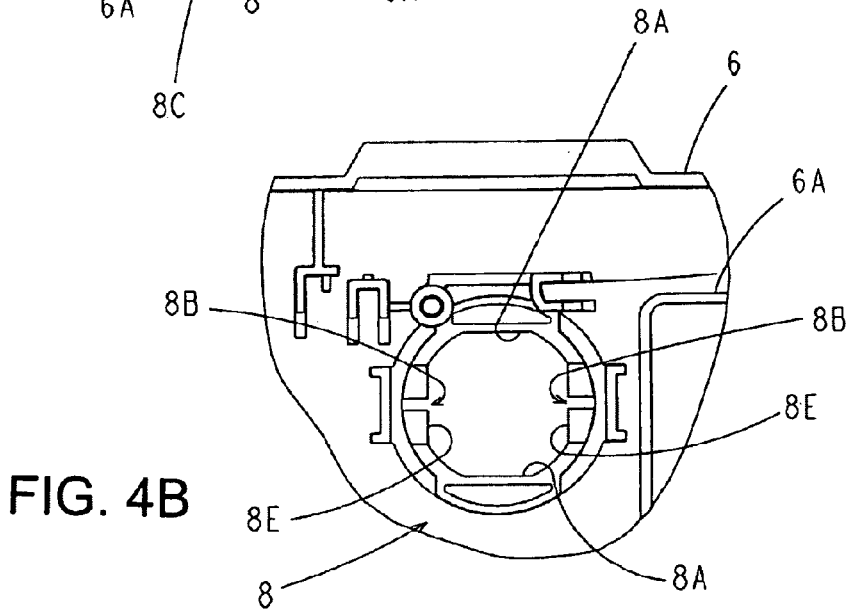
FIG. 4B provides a more detailed back view of the lock socket of our snap-in lock retention system.

FIG. 1 illustrates a portable fireproof safe (denoted generally by arrow 1) with handle 2, lid 3, and base 4. As previously discussed, lid 3 and base 4 are formed by joining molded interior and exterior shells and filling the space between with a fireproof filler such as concrete. Upper escutcheon plate 5 and lower escutcheon plate 6 are affixed in this concrete before it hardens via upper anchors (not shown) and lower anchors 6A in a manner typical for our safes of this type.

As better seen in the remaining drawing figures, our invention allows a key cylinder lock (denoted generally by arrow 7) to be snap fit into an escutcheon plate (such as lower escutcheon plate 6) in a secure mount that holds the lock 7 irremovably in place in a proper position so that it cannot rotate and cannot slide axially inward or outward. It eliminates the need for any fastener, since the complete locking effect is supplied by the interlocking features of lock 7 and its lock socket (denoted generally by arrow 8) located in lower escutcheon plate 6.

Lock socket 8 with its key cylinder aperture (denoted by arrow 9) is molded into lower escutcheon plate 6. (See, FIGS. 2A through 4B.) It has a pair of lock alignment flats 8A to receive lock 7 in a proper orientation and block rotational movement of lock 7 after it is received. It also has an opposed pair of resilient snap locks (denoted by arrows 8B) that are free to move radially in and out by virtue of slots 8C that partially separate the snap locks 8B from the rest of lower escutcheon plate 6 and lock socket 8. Slots 8C (and the arms of snap locks 8B) are perpendicular to the central axis of cylindrical key cylinder lock 7 and generally parallel to escutcheon plate 6. Thus, snap locks 8B also flex outward and inward in a plane that is perpendicular to the axis of lock 7 and generally parallel to escutcheon plate 6. Snap locks positioned on arms flexing in a plane parallel to lock 7 could also be used. However, our arrangement is more advantageous as it allows for a more compact and unobtrusive lock socket 8. It also makes it easier to insert our preferred lock 7 with lock bar 12 into socket 8.

Lock socket 8 is adapted by shape and design to have the back end 7A of lock 7 inserted therein via aperture 9 until only its front end 7B is accessible via aperture 9. Insertion blocking ledges 9A of aperture 9 extend radially inward so as to come into contact with an insertion blocking member such as flange 10 of lock 7 when lock 7 is fully inserted into aperture 9, thereby blocking further inward movement of lock 7.

Figure 5A:
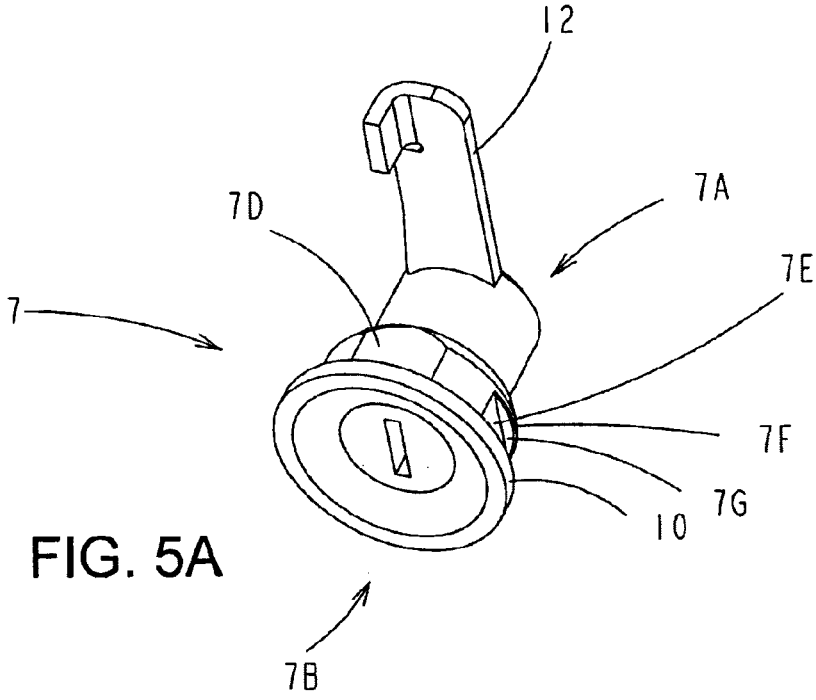
FIG. 5A provides a perspective view of the snap-in lock used in our snap-in lock retention system.
Figure 5B:
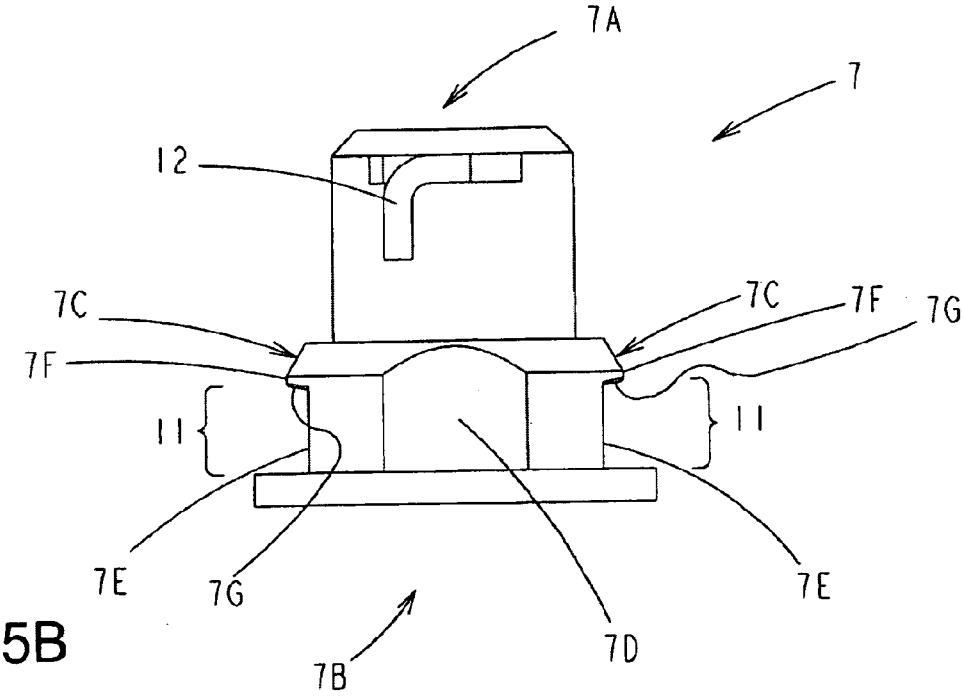
FIG. 5B provides a side view of the snap-in lock used in our snap-in lock retention system.

As illustrated in FIGS. 5A and 5B, lock 7 has removal blocking members comprised of opposing cam surfaces 7C leading up to the diameter (denoted by bracket 11) that fits into lock socket 8. Diameter 11 includes a pair of socket alignment flats 7D sized and positioned to allow insertion only when aligned with lock alignment flats 8A of lock socket 8. It also includes a pair of snap lock flats 7E behind cam surfaces 7C. As lock 7 is inserted, cam surfaces 7C radially spread open resilient snap locks 8B. Snap locks 8B (assisted in part by ramped edges 8F) pass over retainer lips 7F of cam surfaces 7C and snap into snap lock flats 7E. Removal blocking surfaces 7G retain lock 7 in socket 8 by blocking subsequent outward axial movement and removal. The outward facing surfaces 8D of snap locks 8B, like blocking ledges 9A, serve to block further inward movement by flange 10. (In order to avoid overcrowding of the drawing figures, not all outward facing surfaces 8D are numbered.) Similarly, the snug abutment of flat snap lock aperture edges 8E with snap lock flats 7E serve, along with the snug abutment of socket alignment flats 7D and lock alignment flats 8A, to prevent rotation of lock 7. (In order to avoid overcrowding of the drawing figures, not all of the snap lock aperture edges 8E are numbered.)

Our invention allows lock 7 with its lock bar 12 to be maneuvered into lock socket 8 via aperture 9 and then simply snapped into place. The assembly needs no fasteners or anchorage other than escutcheon plate 6, which is secured to safe 1 by its interlock with the concrete insulation material that fills the walls of safe 1. However, it should be obvious that numerous variations are possible without exceeding the spirit and scope of our invention. The general ambit and scope of which can be better determined by examination of the claims that follow.

| Parts List | |
|---|---|
| 1 | portable fireproof safe |
| 2 | handle |
| 3 | lid |
| 4 | base |
| 5 | upper escutcheon plate |

-continued

| Parts List | |
|---|---|
| 6 | lower escucheon plate |
| 6A | lower anchors |
| 7 | key cylinder lock |
| 7A | back end |
| 7B | front end |
| 7C | opposing cam surfaces |
| 7D | socket alignment flats |
| 7E | snap lock flats |
| 7F | retainer lips |
| 7G | removal blocking surfaces |
| 8 | lock socket |
| 8A | lock alignment flats |
| 8B | snap locks |
| 8C | slots |
| 8D | outward facing surfaces |
| 8E | snap lock aperture edges |
| 8F | ramped edges |
| 9 | key cylinder aperture |
| 9A | insertion blocking ledges |
| 10 | flange |
| 11 | diameter |
| 12 | lock bar |

We claim:

1. A lock retainer assembly, comprising:

a lock socket molded into an escutcheon plate, which lock socket has at least one lock alignment flat to receive a lock in a proper orientation and at least one resilient snap lock that is free to move radially in and out;

a cylindrical lock having at least one cam surface leading up to a diameter that fits in the lock socket, the diameter including at least one socket alignment flat for alignment with the lock alignment flat in order to assure proper orientation of the lock in the lock socket such that as the lock is inserted, the at least one cam surface radially spreads open the at least one resilient snap lock, which passes over a retainer lip and snaps into position behind the retainer lip so as to retain the cylindrical lock against outward axial movement; and a flange on the outside of the cylindrical lock that limits the depth of insertion of the cylindrical lock into the lock socket.

2. A lock retainer assembly as described in claim 1, wherein said resilient snap lock has radially flexible arms lying in a plane that is substantially perpendicular to the axis of the lock cylinder.

3. A lock retainer assembly as described in claim 1, wherein alignment and abutment of said lock alignment flat and said socket alignment flat prevent rotation of the cylindrical lock around its axis.

4. A lock retainer assembly as described in claim 1, wherein said lock cylinder further includes a snap lock flat such that abutment of said snap lock flat and said at least one resilient snap lock prevents rotation of the cylindrical lock around its axis.

5. A lock retainer assembly as described in claim 1, further including a cam surface on the snap lock that contacts the cam surface of the lock cylinder when the lock cylinder is being inserted into the socket and facilitates movement of the cam surface of the lock cylinder past the retainer lip.

6. A lock retainer assembly, comprising:

a key cylinder having a front end for key insertion and a back end, the key cylinder having at least one removal blocking member and at least one insertion blocking member extending radially outward, the removal blocking member having a camming surface with a removal blocking surface on the other side of a lip therefrom;

a key cylinder aperture in an escutcheon, which aperture is adapted to have the back end of the key cylinder inserted therein until only the front end is accessible via said key cylinder aperture, the aperture having at least one insertion blocking ledge extending radially inward so as to come into contact with the insertion blocking member when the key cylinder is fully inserted into the aperture; and resilient snap locks connected to said escutcheon, each of which snap locks has a camming surface such that the insertion of the key cylinder into the key cylinder aperture causes the camming surface of said resilient snap locks to contact the camming surface of the removal blocking members of said key cylinder, thereby deflecting the resilient snap locks sufficiently for said removal blocking member to move past said resilient snap assemblies whereupon said snap assemblies snap into position behind the lip adjacent the removal blocking surfaces of said locking members.

7. A lock retainer assembly as described in claim 6, wherein said resilient snap locks have radially flexible arms lying in a plane that is substantially perpendicular to the axis of the key cylinder.

8. A lock retainer assembly as described in claim 6, further comprising at least one alignment flat on said key cylinder and one alignment flat on said socket such that alignment of said flats assures proper alignment of the lock with the socket for insertion and abutment of said flats prevents rotation of the key cylinder around its axis.

9. A lock retainer assembly as described in claim 7, further comprising at least one alignment flat on said key cylinder and one alignment flat on said socket such that alignment of said flats assures proper alignment of the lock with the socket for insertion and abutment of said flats prevents rotation of the key cylinder around its axis.

10. A lock retainer assembly as described in claim 6, wherein said key cylinder further includes snap assembly flats such that abutment of said snap assembly flats and said resilient snap locks prevents rotation of the cylindrical lock around its axis.

11. A lock retainer assembly as described in claim 6, further including cam surfaces on the snap locks that contact the cam surfaces of the key cylinder when the lock cylinder is being inserted into the socket and facilitate movement of the cam surfaces of the lock cylinder past the lip.

12. A lock retainer assembly, comprising a lock cylinder and a socket combination wherein the lock cylinder is retained in the socket by a retainer lip of the lock cylinder that limits extraction after insertion, the retainer lip being positioned at the edge of a cam surface on the lock cylinder and having a snapped interlock with a snap lock having radially flexible arms molded into the socket, the arms lying in a plane that is substantially perpendicular to the axis of the lock cylinder and being forced radially outward by the cammed surface as the lock cylinder is inserted, the lock retainer assembly further including a cam surface on the snap lock that contacts the cam surface of the lock cylinder when the lock cylinder is being inserted into the socket and facilitates movement of the cam surface of the lock cylinder past the snap lock.

* * * * *